US011047103B2

(12) United States Patent
Funakoshi et al.

(10) Patent No.: US 11,047,103 B2
(45) Date of Patent: Jun. 29, 2021

(54) CONCRETE FOUNDATION STRUCTURE AND METHOD FOR CONSTRUCTING SAME

(71) Applicant: Prex Co., Ltd, Kobe (JP)

(72) Inventors: Yumiko Funakoshi, Hyogo (JP); Yu Nagayama, Hyogo (JP)

(73) Assignee: Prex Co., Ltd, Hyogo (JP)

( * ) Notice: Subject to any disclaimer, the term of this patent is extended or adjusted under 35 U.S.C. 154(b) by 0 days.

(21) Appl. No.: 16/644,551

(22) PCT Filed: Dec. 17, 2019

(86) PCT No.: PCT/JP2019/049486
§ 371 (c)(1),
(2) Date: Mar. 5, 2020

(87) PCT Pub. No.: WO2020/202658
PCT Pub. Date: Oct. 8, 2020

(65) Prior Publication Data

US 2021/0062451 A1 Mar. 4, 2021

(30) Foreign Application Priority Data

Apr. 2, 2019 (JP) ..... JP2019-070944

(51) Int. Cl.
*E02D 27/50* (2006.01)
*E02D 27/01* (2006.01)
(Continued)

(52) U.S. Cl.
CPC ..... *E02D 27/016* (2013.01); *E02D 5/36* (2013.01); *E02D 27/02* (2013.01); *E02D 27/50* (2013.01);
(Continued)

(58) Field of Classification Search
CPC ..... E02D 27/02; E02D 27/50
(Continued)

(56) References Cited

U.S. PATENT DOCUMENTS 107,637 A * 9/1870 Stribling
885,043 A * 4/1908 Hambay
(Continued)

FOREIGN PATENT DOCUMENTS

CN 102979109 A 3/2013
CN 103334357 A 10/2013
(Continued)

OTHER PUBLICATIONS

International Search Report (ISR) dated Jan. 28, 2020 filed in PCT/JP2019/049486.
(Continued)

*Primary Examiner* — Sunil Singh
(74) *Attorney, Agent, or Firm* — Rankin, Hill & Clark LLP

(57) ABSTRACT

Provided are a concrete foundation structure capable of firmly fixing a precast concrete foundation to a ground, and a method for constructing the concrete foundation structure. A concrete foundation structure 10 includes a precast concrete foundation 16 having a projecting portion 30 embedded in a ground G. An anchor plate 20 is placed inside an excavation hole 18 formed in the ground G, and the precast concrete foundation 16 and the anchor plate 20 are connected by a connecting member 22. In the excavation hole 18, a backfill portion 24 is formed of a backfill material 94 including a solidifying material and soil. A filler layer 26 is formed of a filler 96 containing a solidifying material between the precast concrete foundation 16 and the backfill portion 24. The precast concrete foundation 16 has a through-hole 42 through which the connecting member 22 is inserted, and the filler 96 forming the filler layer 26 is filled through the through-hole 42.

10 Claims, 9 Drawing Sheets

(51) Int. Cl.
*E02D 27/02* (2006.01)
*E02D 5/36* (2006.01)

(52) U.S. Cl.
CPC ..... *E02D 2250/0023* (2013.01); *E02D 2300/002* (2013.01); *E02D 2600/30* (2013.01)

(58) Field of Classification Search
USPC ..... 52/294, 295, 741.13, 741.15, 742.13, 52/742.14, 742.15
See application file for complete search history.

(56) References Cited

U.S. PATENT DOCUMENTS

| | | | | | |
|---|---|---|---|---|---|
| 1,489,204 | A | * | 4/1924 | Glen | 52/295 |
| 1,858,925 | A | * | 5/1932 | Goodrich | E04H 12/2261 52/295 |
| 3,283,518 | A | * | 11/1966 | Toffolon | E02D 31/14 405/270 |
| 5,678,382 | A | * | 10/1997 | Naito | E02D 27/42 52/295 |
| 6,050,038 | A | * | 4/2000 | Fey | E02D 27/42 52/223.7 |
| 9,003,721 | B1 | * | 4/2015 | Jensen | E02D 27/425 52/126.6 |

FOREIGN PATENT DOCUMENTS

| | | | |
|---|---|---|---|
| CN | 103388341 | A | 11/2013 |
| CN | 103967031 | A | 8/2014 |
| CN | 203808092 | U | 9/2014 |
| CN | 105442627 | A | 3/2016 |
| CN | 206245338 | U | 6/2017 |
| CN | 107816054 | A | 3/2018 |
| JP | 2003-227173 | A | 8/2003 |
| JP | 2011-43027 | A | 3/2011 |
| JP | 2016-108810 | A | 6/2016 |
| KR | 10-1869050 | B1 | 6/2018 |

OTHER PUBLICATIONS

Decision to Grant dated Jul. 8, 2019 for the corresponding Japanese Patent (JP) Application No. 2019-070944.
Chinese Office Action (CNOA) dated Feb. 22, 2021 for the corresponding Chinese Patent Application No. 201980028990.0.
Canadian Office Action dated Feb. 15, 2021 for the corresponding Canadian Patent Application No. 3,099,161.
Korean Office Action dated Feb. 25, 2021 for the corresponding Korean Patent Application No. 10-2020-7031237 and its English machine translation.
Chinese Office Action (CNOA) dated May 21, 2021 for the corresponding Chinese Patent Application No. 201980028990.0.

* cited by examiner

CONCRETE FOUNDATION STRUCTURE AND METHOD FOR CONSTRUCTING SAME

TECHNICAL FIELD

The present invention relates to a concrete foundation structure using a precast concrete foundation and a method for constructing the concrete foundation structure.

BACKGROUND ART

Concrete foundations such as footing foundations, mat foundations, and independent foundations are generally used as foundations for receiving a load of a building. However, when constructing the foundations, since many steps including a step of assembling a formwork on site, a step of incorporating a rebar based on a structural design, a step of pouring concrete into the formwork, a step of hardening the concrete, a step of removing the formwork, and the like are required, there is a problem that a construction period is long. Further, since the foundations are constructed manually on site, there is a problem that an error is likely to occur in finishing accuracy. Furthermore, since it is necessary to secure a skilled technician and a special vehicle such as a concrete pump truck, there is a problem that construction cost increases.

As a typical technique that can solve the above problems, there is a foundation structure disclosed in PATENT LITERATURE 1. The foundation structure includes a concrete foundation plate placed on a surface of a ground and an underground anchor driven into the ground, and the concrete foundation plate and the underground anchor are connected to each other. With the foundation structure, since the concrete foundation plate can be produced in a factory, concrete pouring work and the like on site can be omitted.

CITATION LIST

Patent Literature

PATENT LITERATURE 1: JP-A-2011-043027

However, the foundation structure described in PATENT LITERATURE 1 is used for applications that receive a load of a device such as an electric water heater, and is not intended to be used for applications that receive the load of the building. Therefore, when the foundation structure is used for receiving the load of the building, there is a possibility that the concrete foundation plate sinks, or the underground anchor is pulled out by force of wind hitting the building and the concrete foundation plate moves.

SUMMARY OF THE INVENTION

The present invention has been made to address the above problems, and an object of the present invention is to provide a concrete foundation structure capable of firmly fixing a precast concrete foundation to a ground and a method for constructing the concrete foundation structure.

In order to achieve the above object, a feature of a concrete foundation structure according to the present invention is that the concrete foundation structure includes: a precast concrete foundation placed on a surface of a ground; an excavation hole formed by excavating the ground below the precast concrete foundation; a plate-shaped anchor plate placed inside the excavation hole; a rod-shaped connecting member connecting the precast concrete foundation and the anchor plate; a backfill portion formed by backfilling a backfill material including a solidifying material in the excavation hole; and a filler layer formed by filling a filler including the solidifying material between the precast concrete foundation and the backfill portion, wherein the precast concrete foundation comprises: a foundation body formed to cover the backfill portion from above; and a projecting portion provided to project downward from an outer periphery of the foundation body and embedded in the ground.

According to this configuration, the backfill portion formed below the precast concrete foundation is solidified by using the solidifying material, and the filler layer formed between the precast concrete foundation and the backfill portion is solidified by using the solidifying material, so that the precast concrete foundation can be stably supported by the backfill portion and the filler layer. Further, since the anchor plate connected to the precast concrete foundation is embedded in the backfill portion, the precast concrete foundation and the backfill portion are integrated together, so that the precast concrete foundation can be restrained from moving by a frictional force acting between an outer surface of the backfill portion and an inner surface of the excavation hole. Furthermore, since the projecting portion of the precast concrete foundation is embedded in the ground, the precast concrete foundation can be restrained from moving by the frictional force acting between the projecting portion and the ground. Therefore, the precast concrete foundation can be firmly fixed to the ground.

Another feature of the concrete foundation structure according to the present invention is that the projecting portion is formed annularly on the outer periphery of the foundation body.

According to this configuration, since the projecting portion is formed annularly on the outer periphery of the foundation body, an upper portion of the backfill portion can be surrounded by the projecting portion, and the ground can be present all around the projecting portion. Therefore, when a horizontal external force acts on the precast concrete foundation, the precast concrete foundation can be effectively restrained from moving by the backfill portion and the ground.

Another feature of the concrete foundation structure according to the present invention is that the foundation body is provided with a through-hole through which the connecting member is inserted, and a portion of the connecting member projecting upward from the through-hole is provided with a movement preventing portion that contacts the foundation body and prevents the precast concrete foundation from moving upward.

According to this configuration, an upper end of the connecting member embedded in the backfill portion can be inserted through the through-hole provided in the foundation body, and then the movement preventing portion can be provided in the portion of the connecting member projecting upward from the through-hole. Therefore, when forming the backfill portion, the precast concrete foundation can be separated from the connecting member, and work of forming the backfill portion can be performed efficiently.

Another feature of the concrete foundation structure according to the present invention is that a filler of the same type as the filler is filled in the through-hole, and the filler filled in the through-hole is continuously integrated with the filler forming the filler layer.

According to this configuration, since a first portion of the connecting member present between the precast concrete foundation and the backfill portion and a second portion of the connecting member present inside the through-hole can be wrapped with one continuous filler, it is possible to prevent a shearing force from acting on a boundary between the first portion and the second portion, thereby improving durability of the connecting member.

Another feature of the concrete foundation structure according to the present invention is that the through-hole is formed to have a cross-sectional area decreasing downward.

According to this configuration, since the through-hole is formed to have the cross-sectional area decreasing downward, when the precast concrete foundation is to be separated from the filler layer, the filler filled in the through-hole is caught by the inner surface of the through-hole. Therefore, the precast concrete foundation is difficult to be separated from the filler layer.

In order to achieve the above object, a feature of a method for constructing a concrete foundation structure according to the present invention is that the method includes: a step (a) of excavating a ground to form an excavation hole; a step (b) of attaching a plate-shaped anchor plate to a lower end of a rod-shaped connecting member, and placing the anchor plate and the connecting member inside the excavation hole; a step (c) of backfilling a backfill material including a solidifying material in the excavation hole to form a backfill portion, and projecting an upper end of the connecting member upward from an upper surface of the backfill portion; a step (d) of preparing a precast concrete foundation having a foundation body provided with a through-hole through which the connecting member is inserted; a step (e) of placing the precast concrete foundation on a surface of the ground and inserting the connecting member through the through-hole; a step (f) of filling a filler including a solidifying material between the precast concrete foundation and the backfill portion; and a step (g) of attaching a movement preventing portion to a portion of the connecting member projecting upward from the through-hole, the movement preventing portion contacting the foundation body and preventing the precast concrete foundation from moving upward.

According to this configuration, in the step (c), since the backfill material including the solidifying material is backfilled in the excavation hole to form the backfill portion, the backfill portion can be formed firmly. Further, in the step (f), since the filler including the solidifying material is filled between the precast concrete foundation and the backfill portion, the filler layer formed of the filler can be formed firmly. Therefore, the precast concrete foundation can be stably supported by the backfill portion and the filler layer. Further, the anchor plate and the connecting member are arranged inside the excavation hole in the step (b), the backfill material is backfilled in the excavation hole to form the backfill portion in the step (c), and the movement preventing portion is attached to the portion of the connecting member projecting upward from the through-hole in the step (g), so that the precast concrete foundation and the backfill portion can be integrated together. Therefore, the precast concrete foundation can be restrained from moving by the frictional force acting between the outer surface of the backfill portion and the inner surface of the excavation hole.

Another feature of the method for constructing the concrete foundation structure according to the present invention is that, in the step (f), the filler is also filled in the through-hole, and the filler filled between the precast concrete foundation and the backfill portion and the filler filled in the through-hole are continuously integrated together.

According to this configuration, since the first portion of the connecting member present between the precast concrete foundation and the backfill portion and the second portion of the connecting member present inside the through-hole can be wrapped with one continuous filler, it is possible to prevent the shearing force from acting on the boundary between the first portion and the second portion, thereby improving the durability of the connecting member.

Another feature of the method for constructing the concrete foundation structure according to the present invention is that, in the step (f), the filler is filled between the precast concrete foundation and the backfill portion through the through-hole.

According to this configuration, since the filler is filled between the precast concrete foundation and the backfill portion through the through-hole through which the connecting member is inserted, it is not necessary to separately form a through-hole for filling the filler, and production cost of the precast concrete foundation can be kept low.

Another feature of the method for constructing the concrete foundation structure according to the present invention is that, in the step (c), the backfill portion is compacted.

According to this configuration, in the step (c), since the backfill portion is compacted, the backfill portion can be formed more firmly.

Another feature of the method for constructing the concrete foundation structure according to the present invention is that, in the step (e), a height adjuster having a male screw extending in a vertical direction and a female screw screwed onto the male screw is attached to a side surface of the precast concrete foundation, and the male screw is rotated to adjust a length of a portion of the male screw projecting downward from the precast concrete foundation, so that a height of the precast concrete foundation is adjusted.

According to this configuration, in the step (e), since the height of the precast concrete foundation is adjusted, the concrete foundation structure can be constructed with high accuracy. Further, since the height adjuster has a simple structure having a male screw and the female screw, height adjusting operation can be easily performed.

DESCRIPTION OF THE EMBODIMENTS

Hereinafter, a concrete foundation structure and a method for constructing the concrete foundation structure according to an embodiment of the present invention will be described with reference to the drawings.

(Concrete Foundation Structure)

Figure 1:
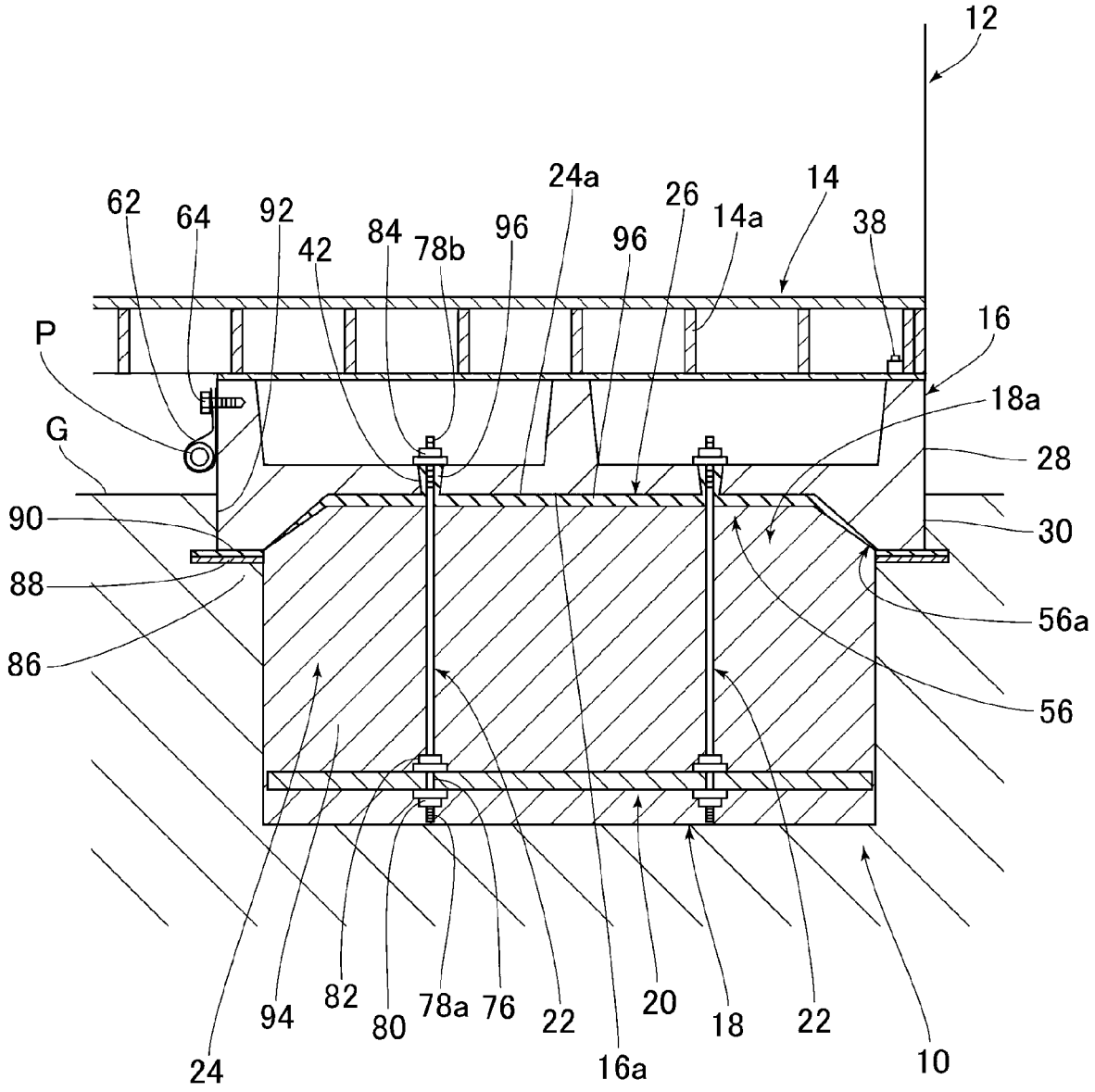
FIG. 1 is a cross-sectional view showing a structure of a concrete foundation structure according to an embodiment of the present invention.
Figure 2:
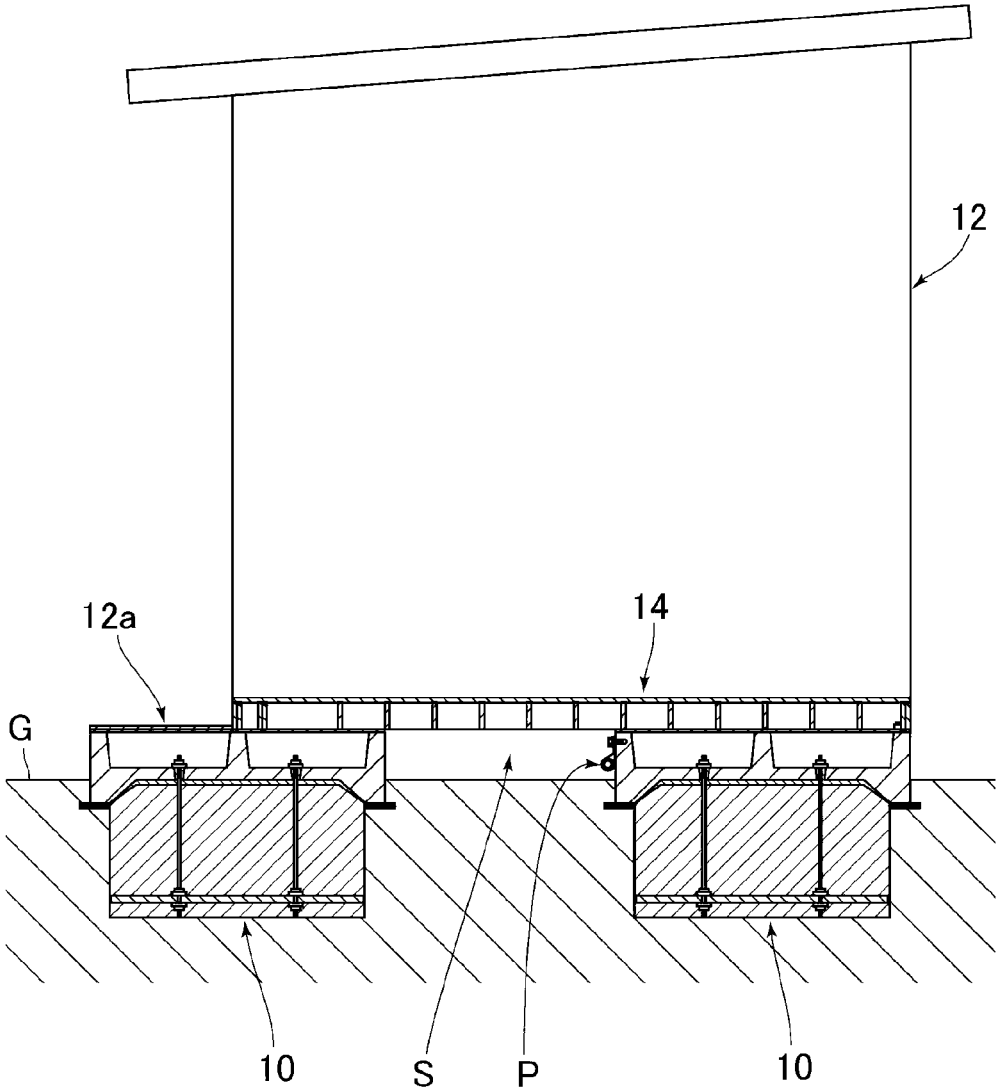
FIG. 2 is a cross-sectional view showing an example of using the concrete foundation structure according to the embodiment of the present invention.
Figure 3:
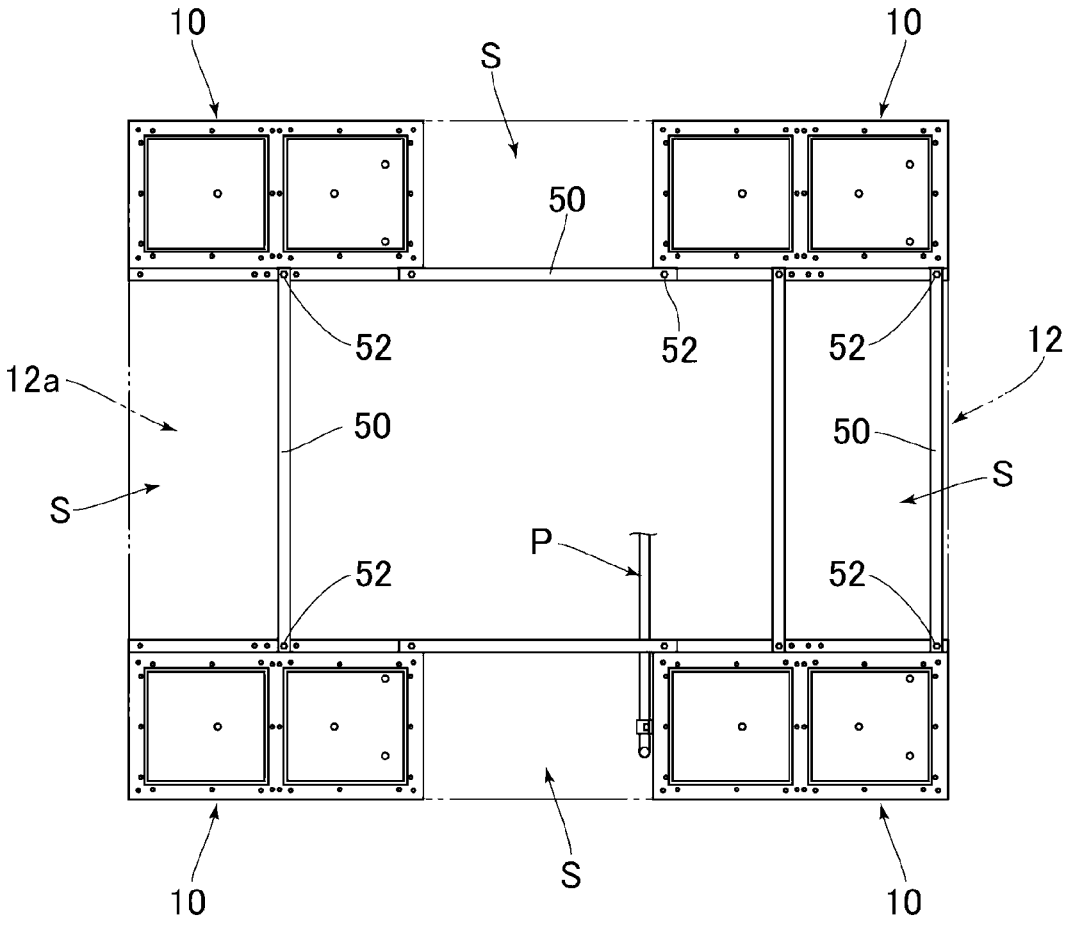
FIG. 3 is a plan view showing the example of using the concrete foundation structure according to the embodiment of the present invention.
Figure 4:
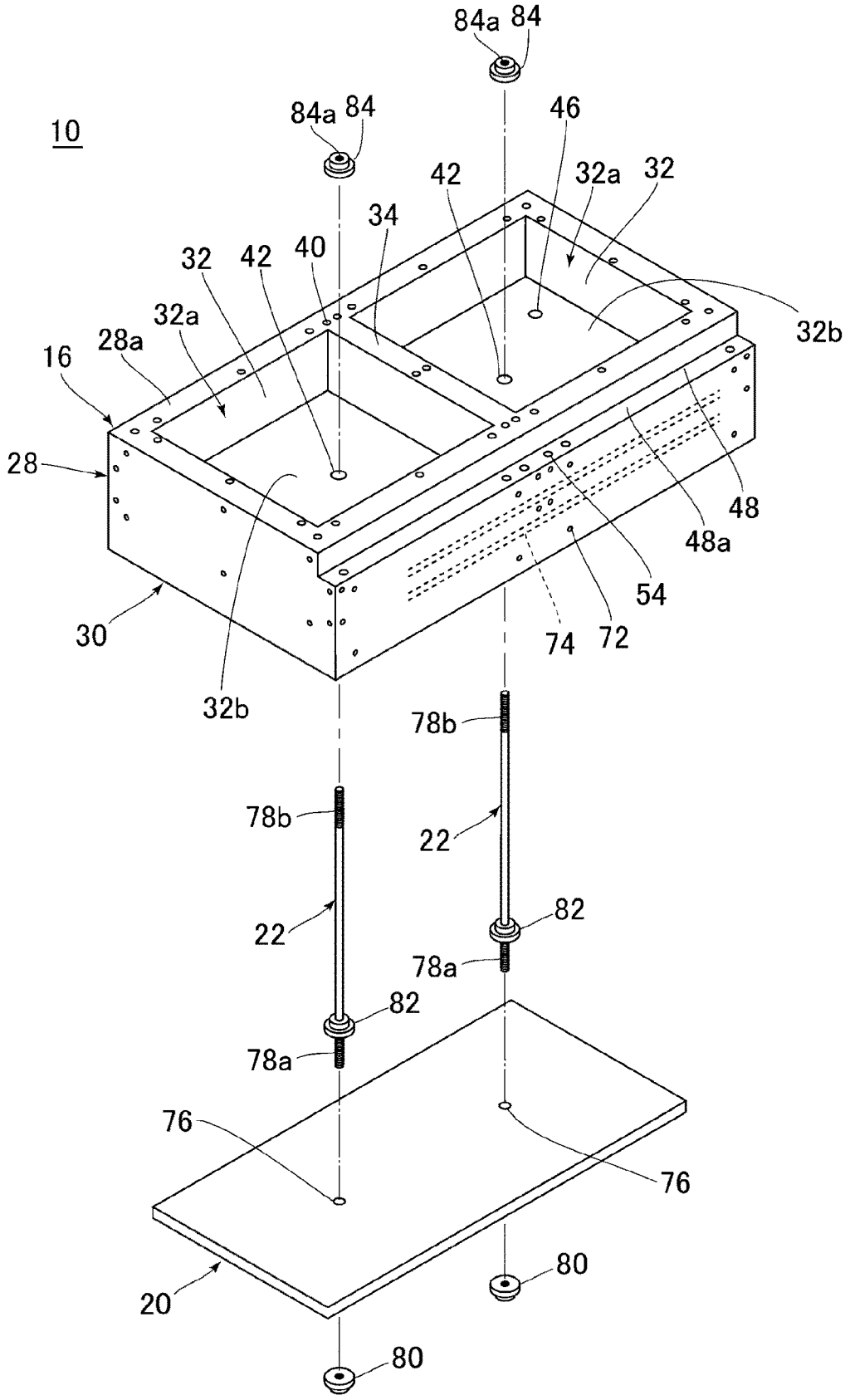
FIG. 4 is an exploded perspective view showing a part of the structure of the concrete foundation structure as viewed obliquely from above.
Figure 5:
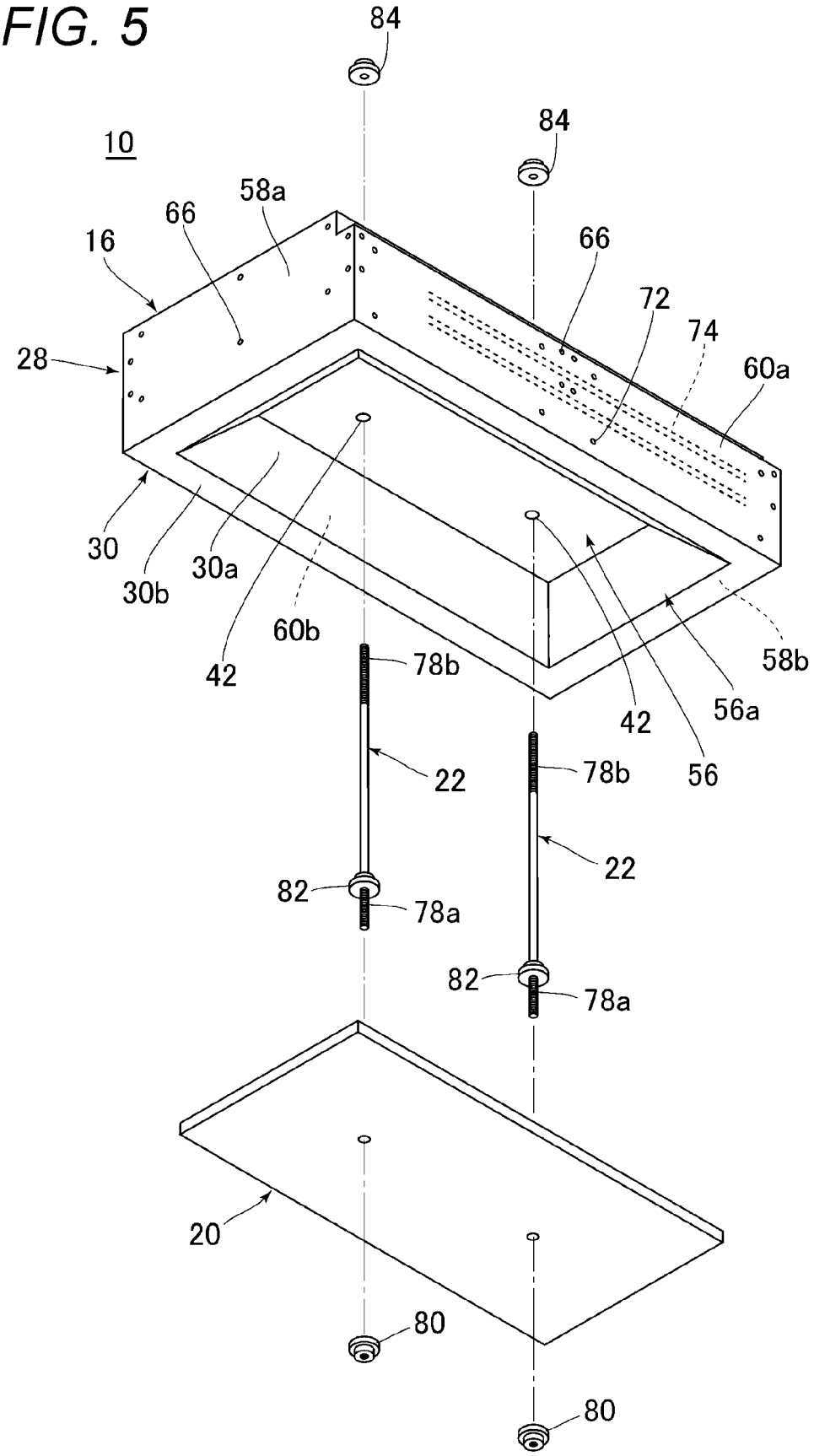
FIG. 5 is an exploded perspective view showing the part of the structure of the concrete foundation structure as viewed from obliquely below.

FIG. 1 is a cross-sectional view showing a structure of a concrete foundation structure 10 according to an embodiment of the present invention. FIG. 2 is a cross-sectional view showing an example of using the concrete foundation structure 10. FIG. 3 is a plan view showing the example of using the concrete foundation structure 10. FIG. 4 is an exploded perspective view showing a part of the structure of the concrete foundation structure 10 as viewed obliquely from above. FIG. 5 is an exploded perspective view showing the part of the structure of the concrete foundation structure 10 as viewed from obliquely below.

The concrete foundation structure 10 shown in FIG. 1 is a structure that receives a load of a building 12 on a surface of a ground G. In examples of use shown in FIGS. 2 and 3, four concrete foundation structures 10 are constructed at a distance from each other to secure a required supporting area (for example, ⅓ or more of a floor area) determined according to the floor area of the building 12. On an upper portion of each concrete foundation structure 10, joists 14*a* constituting a floor structure 14 are fixed, and a load of an entrance porch 12*a* is received using each half of two concrete foundation structures 10.

A space S (including soil) through which various pipes P for water and sewage, electricity, gas, and the like are inserted is formed between two adjacent concrete foundations structures 10. The space S is a ventilation path for taking in outside air into an underfloor space and discharging moisture in the underfloor space to the outside. As shown in FIG. 1, the pipes P are fixed to the concrete foundation structure 10 using a pipe holding member 62.

As shown in FIG. 1, the concrete foundation structure 10 includes a precast concrete foundation 16, an excavation hole 18, an anchor plate 20, two connecting members 22, a backfill portion 24, and a filler layer 26. Among them, the precast concrete foundation 16, the anchor plate 20 and the two connecting members 22 are manufactured in a factory, and the excavation hole 18, the backfill portion 24 and the filler layer 26 are formed on site.

As shown in FIGS. 4 and 5, the precast concrete foundation 16 is a plate-shaped or block-shaped member formed of concrete and having a rectangular shape in a plan view. The precast concrete foundation 16 includes a foundation body 28 formed to cover the backfill portion 24 (FIG. 1) from above, and a projecting portion 30 provided to project downward from an outer periphery of the foundation body 28 and embedded in the ground G (FIG. 1).

As shown in FIG. 4, the foundation body 28 has two recesses 32 that are open upward and are quadrangular in a plan view. The two recesses 32 are provided side by side in a length direction of the foundation body 28, and a partition 34 is formed between the two recesses 32. An upper surface 28*a* of the foundation body 28 in which an opening 32*a* of each recess 32 is opened is formed at a constant height and flat. The upper surface 28*a* is a support surface for receiving the load of the building 12. Further, a plurality of female screw members 40 into which bolts 38 for fixing the joists 14*a* and the like shown in FIG. 1 are screwed are embedded in the upper surface 28*a*.

A through-hole 42 through which the connecting member 22 is inserted is provided in each of bottom portions 32*b* of the two recesses 32. In addition, a plurality of female screw members 46 into which hanging metal fittings 44 (FIGS. 8(A) and 8(B)) such as eyebolts are screwed are respectively embedded in the bottom portions 32*b* of the two recesses 32.

The through-hole 42 has both a function of inserting the connecting member 22 therethrough and a function of introducing a filler 96 (FIG. 9) between the precast concrete foundation 16 and the backfill portion 24. The through-hole 42 is formed in a tapered shape so as to have a cross-sectional area decreasing downward.

In the concrete foundation structure 10 shown in FIG. 1, the connecting member 22 is inserted into the through-hole 42. Further, a filler 96 of the same type as the filler 96 described below that forms the filler layer 26 is filled in the through-hole 42. The filler 96 filled in the through-hole 42 is continuously integrated with the filler 96 forming the filler layer 26.

As shown in FIG. 4, a step portion 48 is formed at one end in a width direction (a direction perpendicular to the length direction) of the upper portion of the foundation body 28. The upper surface 48*a* of the step portion 48 is formed flat at a lower height than the upper surface 28*a* of the foundation body 28. The upper surface 48*a* is a support surface for supporting a rod-shaped support 50 (FIG. 3) and the like that receives the load of the building 12. A plurality of female screw members 54 into which bolts 52 (FIG. 3) for fixing the support 50 and the like are screwed are embedded in the upper surface 48*a* of the step portion 48.

As shown in FIG. 5, the projecting portion 30 is formed annularly on the outer periphery of the foundation body 28. In the present embodiment, the projecting portion 30 is formed in a quadrangular wall shape in a bottom view so that a shape of the precast concrete foundation 16 is rectangular in a bottom view. A housing space 56 for housing an upper portion of the backfill portion 24 (FIG. 1) is formed inside the projecting portion 30. An inner surface 30*a* of the projecting portion 30 is formed to be inclined so that a transverse surface (a horizontal cross-sectional surface) of the housing space 56 gradually widens downward. A part of a rebar 74 described later is placed to extend in an inclined direction of the inner surface 30*a* of the projecting portion 30, thereby increasing the strength of the projecting portion 30 against an external force acting in a horizontal direction. A lower surface 30*b* of the projecting portion 30 having an opening 56*a* of the housing space 56 is formed flat.

As shown in FIG. 5, a plurality of female screw members 66 into which bolts 64 for fixing the pipe holding member 62 and the like shown in FIG. 1 are screwed are respectively embedded in four side surfaces 58*a*, 58*b*, 60*a*, 60*b* of the precast concrete foundation 16. Further, a plurality of female screw members 72 into which bolts 70 for fixing a height adjuster 68 shown in FIGS. 8(A) and 8(B) are screwed are embedded in the both side surfaces 60*a* and 60*b* in a width direction of the precast concrete foundation 16. Further, in each of the foundation body 28 and the projecting portion 30, the rebar 74 for reinforcing them is embedded.

The size of the precast concrete foundation 16 is set to 2516 mm in length, 1367 mm in width, and 600 mm in height. A weight of the precast concrete foundation 16 is set to 2765 Kg. The size of the opening 56*a* of the housing space 56 is set to 2216 mm in length and 1067 mm in width. The size of the through-hole 42 is set to 60 mm in inner diameter at its upper end and 50 mm in inner diameter at its lower end.

As shown in FIG. 4, the anchor plate 20 is a plate-shaped member having a rectangular shape in a plan view, and is formed of a metal material such as a rolled steel material with a strength that is not easily bent. The anchor plate 20 is provided with two through-holes 76 through which the connecting members 22 are inserted, at intervals in the length direction. The size of the anchor plate 20 is set to 2000 mm in length, 800 mm in width, and 12 mm in thickness.

As shown in FIG. 4, the connecting member 22 is a member for connecting the precast concrete foundation 16 and the anchor plate 20, and is formed of a metal material such as stainless steel into a rod shape having a circular cross-section. A first male screw 78*a* is provided at one end (a lower end) of the connecting member 22, and a second male screw 78*b* is provided at the other end (an upper end) of the connecting member 22. The size of the connecting member 22 is set to 1000 to 2000 mm in length and 20 mm in diameter. The strength of the connecting member 22 is set to 7 t in shear strength.

In the concrete foundation structure 10 shown in FIG. 1, the connecting member 22 is disposed to extend vertically inside the excavation hole 18. Then, the first male screw 78*a* of the connecting member 22 is inserted into the through-hole 76 of the anchor plate 20, and the anchor plate 20 is sandwiched between two female screw members 80 and 82 screwed into the first male screw 78*a*. Thus, the anchor plate 20 is attached to the lower end of the connecting member 22.

Further, the second male screw 78*b* of the connecting member 22 is inserted through the through-hole 42 of the precast concrete foundation 16, and a movement preventing portion 84 is attached to a portion of the second male screw 78*b* projecting upward through the through-hole 42. Thus, the precast concrete foundation 16 is attached to the upper end of the connecting member 22. The movement preventing portion 84 is a member that contacts the foundation body 28 and prevents the precast concrete foundation 16 from moving upward, and has a female screw 84*a* screwed into the second male screw 78*b* of the connecting member 22 as shown in FIG. 4.

As shown in FIG. 1, the excavation hole 18 is formed in a rectangular shape in a plan view by excavating the ground G below the precast concrete foundation 16. A step portion 86 is provided in an inner periphery of an upper portion of the excavation hole 18, and a concrete layer 88 and a dry mortar layer 90 are formed in this order on an upper surface of the step portion 86. The concrete layer 88 is a reinforcing layer for reinforcing the upper surface of the step portion 86, and the dry mortar layer 90 is a height adjustment layer for adjusting a height of the precast concrete foundation 16. A wall surface 92 of the ground G is formed around a region of the dry mortar layer 90 in which the precast concrete foundation 16 is placed. The size of the excavation hole 18 is set to 2100 mm in length, 900 mm in width, and 1000 to 2000 mm in depth.

An opening 18*a* of the excavation hole 18 is disposed inside the opening 56*a* of the housing space 56 of the precast concrete foundation 16 in a plan view, and the wall surface 92 of the ground G is disposed outside an outer surface of the projecting portion 30 of the precast concrete foundation 16 in a plan view. Therefore, the projecting portion 30 of the precast concrete foundation 16 can be placed on the step portion 86, and the precast concrete foundation 16 can be stably supported by the ground G forming the step portion 86.

As shown in FIG. 1, the backfill portion 24 is formed by backfilling a backfill material 94 including a cement-based solidifying material that is solidified by reaction with water and the soil into the excavation hole 18. Further, the backfill portion 24 is firmly hardened by being compacted, and an outer surface of the backfill portion 24 is in close contact with an inner surface of the excavation hole 18. Since the excavation hole 18 of the present embodiment is formed in a rectangular shape in a plan view, the backfill material 94 backfilled in the excavation hole 18 is solidified into a quadrangular prism shape inside the excavation hole 18, to be integrated with the anchor plate 20 and the connecting member 22. The upper portion of the backfill portion 24 is housed in the housing space 56 of the precast concrete foundation 16, and an entire upper surface 24*a* of the backfill portion 24 is placed facing a lower surface 16*a* of the precast concrete foundation 16 forming the housing space 56.

As shown in FIG. 1, the filler layer 26 is formed by filling the filler 96 including the cement-based solidifying material that is solidified by reaction with water into a space between the precast concrete foundation 16 and the backfill portion 24. The filler 96 is sometimes called "cement milk". As described above, in the present embodiment, since the entire upper surface 24*a* of the backfill portion 24 is placed facing the lower surface 16*a* of the precast concrete foundation 16, the entire upper surface 24*a* of the backfill portion 24 and the lower surface 16*a* of the precast concrete foundation 16 can be connected to each other by the filler layer 26. Therefore, the load of the building 12 acting on the precast concrete foundation 16 can be received by the entire backfill portion 24.

(Method for Constructing Concrete Foundation Structure)

Figure 6:
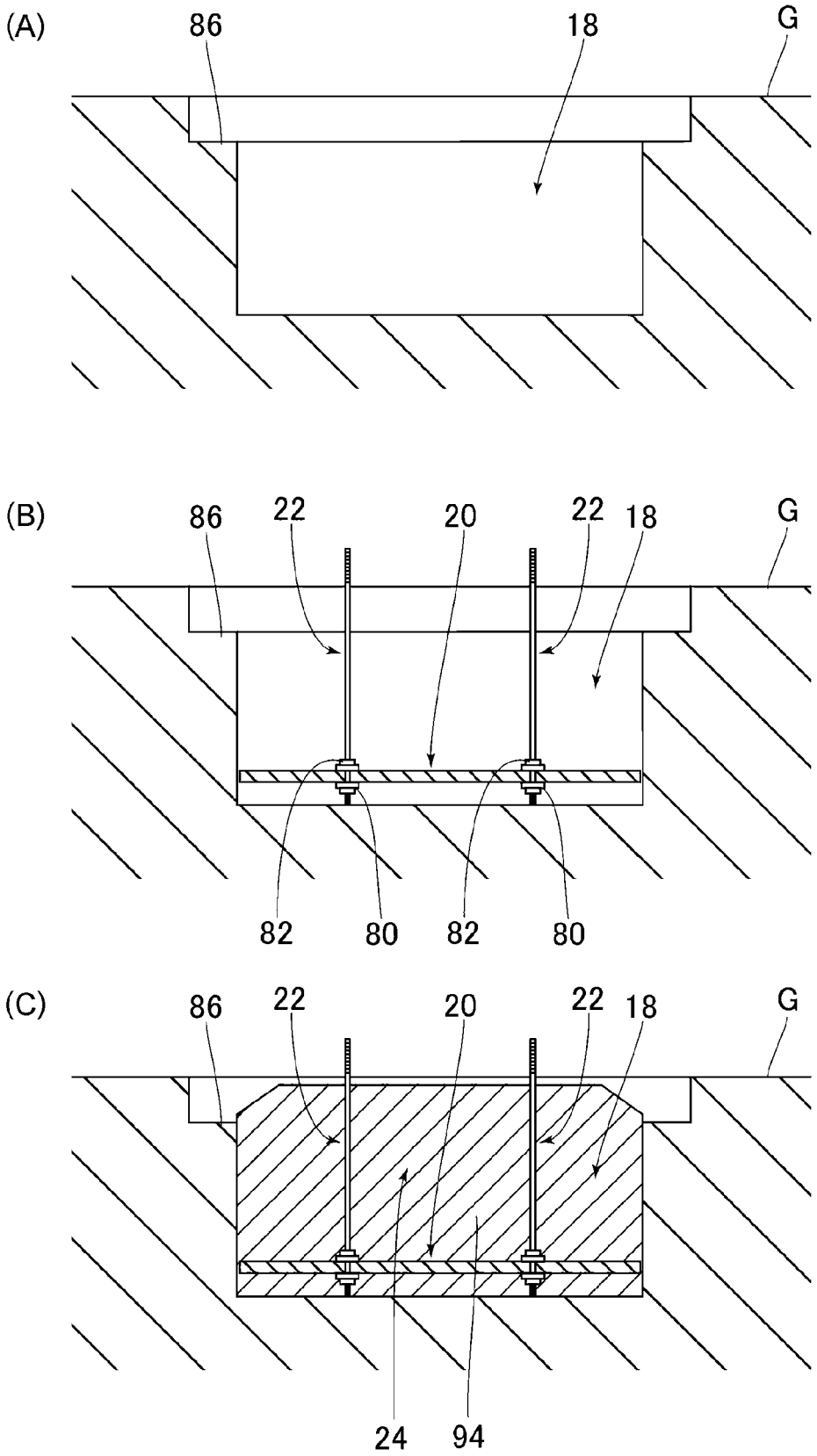
FIG. 6(A) is a cross-sectional view showing a step of providing an excavation hole.
FIG. 6(B) is a cross-sectional view showing a step of placing an anchor plate and a connecting member inside the excavation hole.
FIG. 6(C) is a cross-sectional view showing a step of backfilling a backfill material in the excavation hole.

FIG. 6(A) is a cross-sectional view showing a step of providing the excavation hole 18, FIG. 6(B) is a cross-sectional view showing a step of placing the anchor plate 20 and the connecting member 22 inside the excavation hole 18, and FIG. 6(C) is a cross-sectional view showing a step of backfilling the backfill material 94 in the excavation hole 18. FIG. 7(D) is a cross-sectional view showing a step of placing the precast concrete foundation 16 on the surface of the ground G, FIG. 7(E) is a cross-sectional view showing a step of forming the filler layer 26, and FIG. 7(F) is a cross-sectional view showing a step of attaching the precast concrete foundation 16 to the connecting member 22. When constructing the concrete foundation structure 10, a constructor performs the following steps (a) to (g) in this order.

In the step (a), a position at which the concrete foundation structure 10 is constructed is determined at a construction site of the building 12 (FIG. 3). Then, as shown in FIG. 6(A), the excavation hole 18 is formed by excavating the ground G at the determined position. At this time, the step portion 86 is formed in the inner periphery of the upper portion of the excavation hole 18.

In the step (b), the anchor plate 20 shown in FIGS. 4 and 5 is attached to the lower end of the rod-shaped connecting member 22 using the two female screw members 80 and 82. Then, as shown in FIG. 6(B), the anchor plate 20 and the two connecting members 22 are placed inside the excavation hole 18. At this time, the anchor plate 20 is placed horizontally, and the two connecting members 22 are placed vertically to the anchor plate 20.

In the step (c), as shown in FIG. 6(C), the backfill material 94 including the solidifying material that is solidified by reaction with water and the soil is backfilled in the excavation hole 18 to form the backfill portion 24. Further, the upper end of the connecting member 22 is projected upward from the upper surface 24*a* of the backfill portion 24. Then, the backfill portion 24 is compacted to release air contained in the backfill portion 24. Then, the backfill portion 24 is hardened together with the solidifying material reacting with soil moisture and being solidified.

In the step (d), the precast concrete foundation 16 shown in FIGS. 4 and 5 is prepared. The precast concrete foundation 16 has the foundation body 28 and the projecting portion 30, and the foundation body 28 is provided with the through-hole 42 through which the connecting member 22 is inserted. Since the size and weight of the precast concrete foundation 16 are determined as described above, the precast concrete foundation 16 can be carried by a vehicle, and the precast concrete foundation 16 manufactured with high precision using factory equipment can be loaded on the vehicle and brought to the site.

In the step (e), as shown in FIG. 7(D), the precast concrete foundation 16 is placed on the surface of the ground G, and the connecting member 22 is inserted through the through-hole 42. Further, the height of the precast concrete foundation 16 is adjusted using two height adjusters 68 shown in FIGS. 8 (A) and 8 (B).

FIG. 8(A) is a front view showing a state in which the height adjuster 68 is attached to the precast concrete foundation 16, and FIG. 8(B) is a plan view showing the state in which the height adjuster 68 is attached to the precast concrete foundation 16.

As shown in FIGS. 8(A) and 8(B), the height adjuster 68 includes two male screws 98 extending vertically, support bodies 100 having female screws 100*a* into which the male screws 98 are screwed, and a base body 102 to which two support bodies 100 are fixed. A length of the base body 102 is set to be substantially the same as the length of the precast concrete foundation 16. The two support bodies 100 are fixed to both ends in a longitudinal direction of the base body 102. The base body 102 is provided with a plurality of through-holes 104 through which the bolts 70 screwed into the female screw members 72 (FIGS. 4 and 5) of the precast concrete foundation 16 are inserted.

When adjusting the height of the precast concrete foundation 16, as shown in FIG. 8(B), the two height adjusters 68 are attached to the both side surfaces 60*a* and 60*b* in the width direction of the precast concrete foundation 16 using the bolts 70. Further, as shown in FIG. 7(D), the concrete layer 88 and the dry mortar layer 90 are formed in this order on the upper surface of the step portion 86. Subsequently, the precast concrete foundation 16 is suspended by a wire W shown in FIGS. 8(A) and 8(B), and is placed on the dry mortar layer 90, and the height of the precast concrete foundation 16 is measured. Then, by rotating the male screw 98 and changing a length of a projecting portion 98*a* of the male screw 98 projecting downward from the precast concrete foundation 16, the height of the precast concrete foundation 16 is adjusted so that a measured value matches a design value.

In the present embodiment, since four male screws 98 are attached to the precast concrete foundation 16, the height of the precast concrete foundation 16 can be accurately adjusted by appropriately rotating each of the male screws 98. Note that the number of the male screws 98 attached to the precast concrete foundation 16 is not particularly limited, but may be three or less, or five or more.

In the step (f), as shown in FIG. 7(E), the filler 96 including the solidifying material that is solidified by reaction with water and the water is filled from the through-hole 42 into the space between the precast concrete foundation 16 and the backfill portion 24. Then, the solidifying material of the filler 96 reacts with water to be solidified, so that the filler layer 26 is formed between the precast concrete foundation 16 and the backfill portion 24. At this time, since a part of the filler 96 penetrates into the backfill portion 24, the filler layer 26 is firmly integrated with the backfill portion 24.

Figure 9:
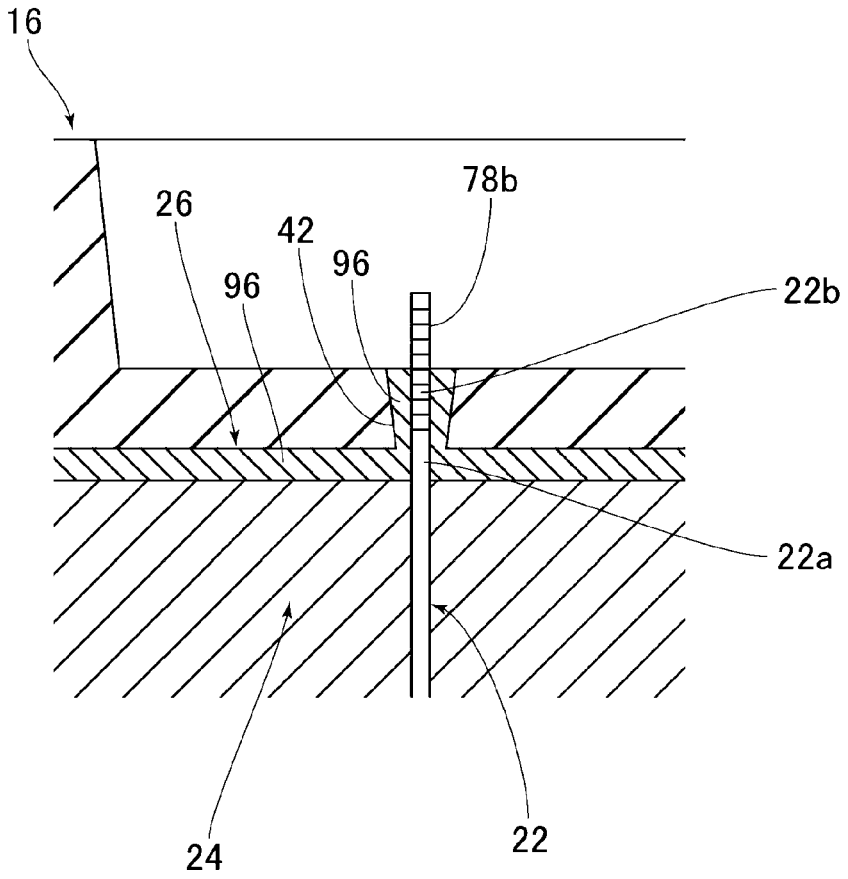
FIG. 9 is a cross-sectional view for describing a step of forming the filler layer in detail.

FIG. 9 is a cross-sectional view for describing a step of forming the filler layer 26 in detail. In the step (f), as shown in FIG. 9, a part of the filler 96 is also filled into the through-hole 42, so that the filler 96 filled into the space between the precast concrete foundation 16 and the backfill portion 24 and the filler 96 filled into the through-hole 42 are continuously integrated together.

Figure 7:
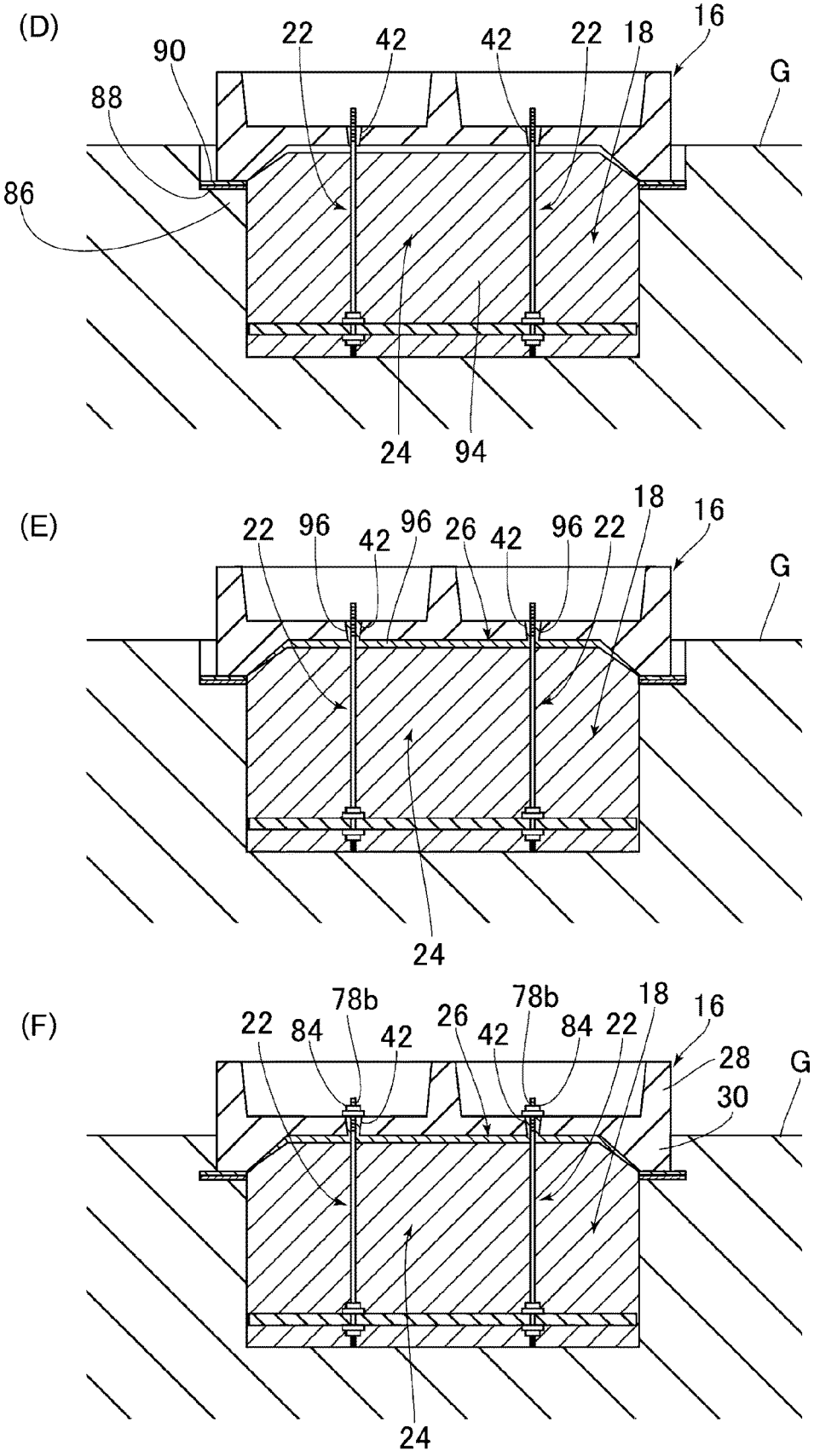
FIG. 7(D) is a cross-sectional view showing a step of placing a precast concrete foundation on a surface of a ground.
FIG. 7(E) is a cross-sectional view showing a step of forming a filler layer.
FIG. 7(F) is a cross-sectional view showing a step of attaching the precast concrete foundation to the connecting member.

In the step (g), as shown in FIG. 7 (F), the movement preventing portion 84 that contacts the foundation body 28 and prevents the precast concrete foundation 16 from moving upward is attached to a portion of the connecting member 22 projecting upward from the through-hole 42. That is, the female screw 84*a* (FIG. 4) of the movement preventing portion 84 is screwed onto the second male screw 78*b* of the connecting member 22.

Effects of Embodiment

According to the present embodiment, the following effects can be obtained by the above configuration. That is, the backfill portion 24 formed below the precast concrete foundation 16 shown in FIG. 1 is solidified using the solidifying material, and the filler layer 26 formed between the precast concrete foundation 16 and the backfill portion 24 is solidified using the solidifying material, so that the backfill portion 24 and the filler layer 26 can stably support the precast concrete foundation 16.

As shown in FIG. 1, since the anchor plate 20 connected to the precast concrete foundation 16 is embedded in the backfill portion 24, the precast concrete foundation 16 and the backfill portion 24 are integrated together, so that the precast concrete foundation 16 can be restrained from moving by a frictional force acting between the outer surface of the backfill portion 24 and the inner surface of the excavation hole 18. Further, since the projecting portion 30 of the precast concrete foundation 16 is embedded in the ground G, the precast concrete foundation 16 can be restrained from moving by the frictional force acting between the projecting portion 30 and the ground G. Therefore, the precast concrete foundation 16 can be firmly fixed to the ground G.

In the present embodiment, since the size, weight, material, and the like of each portion are determined as described above, in the ground G having a ground supporting force of 5 t/m$^2$ or more, a pull-out resistance of 16.7 t can be obtained per one concrete foundation structure 10. Therefore, in the example of using four concrete foundation structures 10 (FIGS. 1 and 2), a high pull-out resistance of 66.8 t can be obtained as a whole, and it can withstand a tornado wind at a wind speed of about 80 m/s.

As shown in FIG. 5, since the projecting portion 30 is formed annularly on the outer periphery of the foundation body 28, the upper portion of the backfill portion 24 can be surrounded by the projecting portion 30, and the wall surface 92 (FIG. 1) of the ground G can be present all around the projecting portion 30. Therefore, when a horizontal external force acts on the precast concrete foundation 16, the precast concrete foundation 16 can be effectively restrained from moving by the backfill portion 24 and the ground G.

As shown in FIG. 1, since the movement preventing portion 84 is attached to the portion of the connecting member 22 projecting upward from the through-hole 42, upon forming the backfill portion 24, the precast concrete foundation 16 can be separated from the connecting member 22, and work of forming the backfill portion 24 can be performed efficiently.

As shown in FIG. 9, a first portion 22*a* of the connecting member 22 present between the precast concrete foundation 16 and the backfill portion 24, and a second portion 22*b* of the connecting member 22 present inside the through-hole 42 can be wrapped with one continuous filler 96, it is possible to prevent a shearing force from acting on a boundary between the first portion 22*a* and the second portion 22*b*, thereby increasing durability of the connecting member 22.

As shown in FIG. 9, since the through-hole 42 is formed to have a cross-sectional area decreasing downward, when the precast concrete foundation 16 is about to be separated from the filler layer 26, the filler 96 filled inside the through-hole 42 is caught by an inner surface of the through-hole 42. Therefore, the precast concrete foundation 16 is hard to be separated from the filler layer 26.

As shown in FIG. 9, since the filler 96 can be filled into the space between the precast concrete foundation 16 and the backfill portion 24 from the through-hole 42 for inserting the connecting member 22, it is not necessary to separately form a through-hole for filling the filler 96, and production cost of the precast concrete foundation 16 can be kept low.

Figure 8:
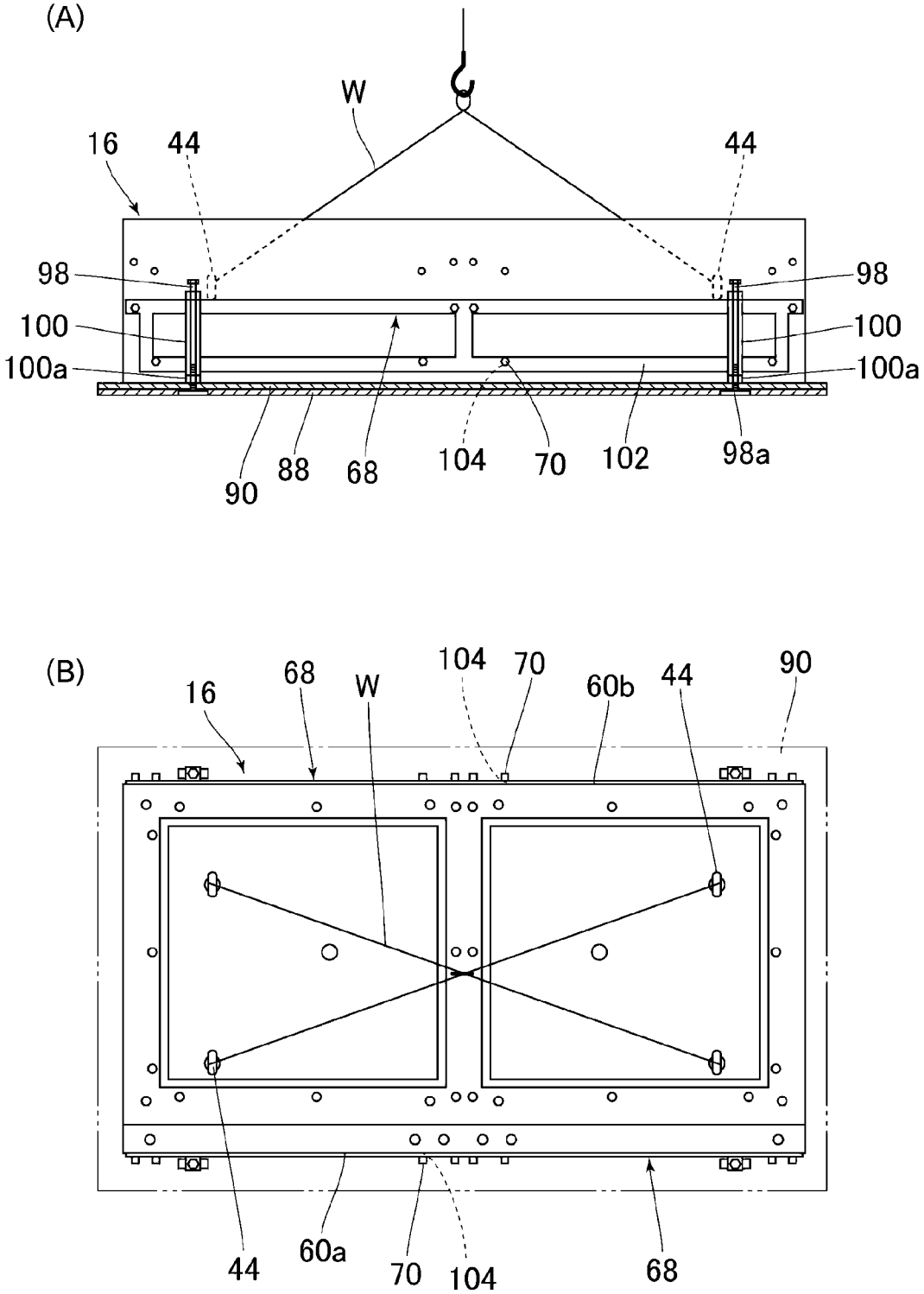
FIG. 8(A) is a front view showing a state in which a height adjuster is attached to the precast concrete foundation.
FIG. 8(B) is a plan view showing the state in which the height adjuster is attached to the precast concrete foundation.

Since the height adjuster 68 shown in FIG. 8 has a simple structure having the male screw 98 and the female screw 100*a*, work of adjusting the height of the precast concrete foundation 16 can be easily performed.

(Modification)

Note that implementation of the present invention is not limited to the above embodiment and various changes can be made without departing from the object of the present invention. That is, in the above embodiment, the concrete foundation structure 10 is used for supporting the building 12; however, the concrete foundation structure 10 may be used for supporting street lights, signboards, greenhouses, mechanical devices, and the like. Further, the size and weight of the concrete foundation structure 10 may be appropriately changed depending on applications.

In the above embodiment, the precast concrete foundation 16 and the anchor plate 20 are formed in a rectangular shape in a plan view; however, they may be formed in other shapes such as a square, a circle, an ellipse, a triangle, a pentagon, and a hexagon in a plan view.

In the above embodiment, the projecting portion 30 is formed annularly on the outer periphery of the foundation body 28; however, the projecting portion 30 may be formed intermittently on the outer periphery of the foundation body 28 or may be formed in a shape in which a part of an annular shape is missing.

In the above embodiment, the through-hole 42 is formed in a tapered shape; however, the shape of the through-hole 42 may be any shape as long as the cross-sectional area decreases downward. For example, the through-hole 42 may be formed in a shape in which a projection is provided on the inner surface of the through-hole formed with a constant inner diameter. Further, a normal through-hole (not shown) having a constant inner diameter may be provided instead of the through-hole 42. Even in this case, since the first portion 22*a* of the connecting member 22 present between the precast concrete foundation 16 and the backfill portion 24, and the second portion 22*b* of the connecting member 22 present inside the through-hole (not shown) can be wrapped with one continuous filler 96, it is possible to prevent the shearing force from acting on the boundary, thereby increasing the durability of the connecting member 22.

In the above embodiment, the anchor plate 20 is fixed to the connecting member 22 with the two female screw members 80 and 82, but a method of fixing the anchor plate 20 may be changed as appropriate. For example, the female screw member 82 placed above the anchor plate 20 may be omitted. Further, the lower end of the connecting member 22 may be bent and hooked on the anchor plate 20.

In the above embodiment, the movement preventing portion 84 is formed as a member having the female screw 84*a* (FIG. 4); however, a structure of the movement preventing portion 84 may be changed as appropriate. For example, when a female screw is provided at the upper end of the connecting member 22, the movement preventing portion 84 may be formed as a member having a male screw screwed into the female screw. Even in this case, the movement preventing portion 84 is attached to the portion of the connecting member 22 projecting upward from the through-hole 42 and contacts the foundation body 28.

In the above embodiment, the cement-based solidifying material is used as the solidifying material of the backfill material 94 and the filler 96; however, another type of solidifying material may be used. For example, a lime-based solidifying material or a composite-based solidifying material in which the cement-based solidifying material and the lime-based solidifying material are mixed may be used. However, in order to obtain stable strength over a long period of time, it is desirable to use the cement-based solidifying material.

In the above embodiment, the filler 96 forming the filler layer 26 is filled from the through-hole 42 through which the connecting member 22 is inserted; however, the filler 96 forming the filler layer 26 may be filled from a through-hole (not shown) provided separately from the through-hole 42.

LIST OF REFERENCE SIGNS

G Ground
10 Concrete foundation structure
12 Building
14 Floor structure
16 Precast concrete foundation
18 Excavation hole
20 Anchor plate
22 Connecting member
24 Backfill portion
26 Filler layer
28 Foundation body
30 Projecting portion
42 Through-hole
68 Height adjuster
84 Movement preventing portion
94 Backfill material
96 Filler

The invention claimed is:

1. A concrete foundation structure comprising:

a precast concrete foundation placed on a surface of a ground;

an excavation hole formed by excavating the ground below the precast concrete foundation;

a plate-shaped anchor plate placed inside the excavation hole;

a rod-shaped connecting member connecting the precast concrete foundation and the anchor plate;

a backfill portion formed by backfilling a backfill material including a first solidifying material in the excavation hole; and a filler layer formed by filling a filler including a second solidifying material between the precast concrete foundation and the backfill portion, wherein the precast concrete foundation comprises:

a foundation body formed to cover the backfill portion from above; and a projecting portion provided to project downward from an outer periphery of the foundation body and embedded in the ground.

2. The concrete foundation structure according to claim 1, wherein the projecting portion is formed annularly on the outer periphery of the foundation body.

3. The concrete foundation structure according to claim 1 or 2, wherein the foundation body is provided with a through-hole through which the rod-shaped connecting member is inserted, and a portion of the rod-shaped connecting member projecting upward from the through-hole is provided with a movement preventing portion that contacts the foundation body and prevents the precast concrete foundation from moving upward.

4. The concrete foundation structure according to claim 3, wherein the filler is filled in the through-hole, and the filler filled in the through-hole is continuously integrated with the filler forming the filler layer.

5. The concrete foundation structure according to claim 4, wherein the through-hole is formed to have a cross-sectional area decreasing downward.

6. A method for constructing a concrete foundation structure, comprising:

a step (a) of excavating a ground to form an excavation hole;

a step (b) of attaching a plate-shaped anchor plate to a lower end of a rod-shaped connecting member, and placing the anchor plate and the rod-shaped connecting member inside the excavation hole;

a step (c) of backfilling a backfill material including a first solidifying material in the excavation hole to form a backfill portion, and projecting an upper end of the rod-shaped connecting member upward from an upper surface of the backfill portion;

a step (d) of preparing a precast concrete foundation having a foundation body provided with a through-hole through which the rod-shaped connecting member is inserted;

a step (e) of placing the precast concrete foundation on a surface of the ground and inserting the rod-shaped connecting member through the through-hole;

a step (f) of filling a filler including a second solidifying material between the precast concrete foundation and the backfill portion; and a step (g) of attaching a movement preventing portion to a portion of the rod-shaped connecting member projecting upward from the through-hole, the movement preventing portion contacting the foundation body and preventing the precast concrete foundation from moving upward.

7. The method for constructing the concrete foundation structure according to claim 6, wherein in the step (f), the filler is also filled in the through-hole, and the filler filled between the precast concrete foundation and the backfill portion and the filler filled in the through-hole are continuously integrated together.

8. The method for constructing the concrete foundation structure according to claim 6, wherein in the step (f), the filler is filled between the precast concrete foundation and the backfill portion through the through-hole.

9. The method for constructing the concrete foundation structure according to claim 6, wherein in the step (c), the backfill portion is compacted.

10. The method for constructing the concrete foundation structure according to claim 6, wherein in the step (e), a height adjuster having a male screw extending in a vertical direction and a female screw screwed onto the male screw is attached to a side surface of the precast concrete foundation, and the male screw is rotated to adjust a length of a portion of the male screw projecting downward from the precast concrete foundation, so that a height of the precast concrete foundation is adjusted.

* * * * *